US009840884B2

(12) United States Patent
Ash et al.

(10) Patent No.: US 9,840,884 B2
(45) Date of Patent: Dec. 12, 2017

(54) DOWNHOLE SEAL ELEMENT AND RELATED APPARATUSES

(71) Applicant: Reeves Wireline Technologies Limited, Leicestershire (GB)

(72) Inventors: Simon Christopher Ash, Nottingham (GB); Charles Richard Easter, Leicestershire (GB)

(73) Assignee: Reeves Wireline Technologies Limited, Leicestershire (GB)

( * ) Notice: Subject to any disclaimer, the term of this patent is extended or adjusted under 35 U.S.C. 154(b) by 296 days.

(21) Appl. No.: 14/172,331

(22) Filed: Feb. 4, 2014

(65) Prior Publication Data

US 2014/0238660 A1 Aug. 28, 2014

(30) Foreign Application Priority Data

Feb. 4, 2013 (GB) ..... 1301925.2

(51) Int. Cl.

| | |
|---|---|
| ***E21B 33/126*** | (2006.01) |
| ***E21B 21/10*** | (2006.01) |
| ***E21B 34/14*** | (2006.01) |
| ***E21B 33/00*** | (2006.01) |

(52) U.S. Cl.

CPC ..... *E21B 33/00* (2013.01); *E21B 33/126* (2013.01); *E21B 2033/005* (2013.01)

(58) Field of Classification Search

CPC ..... E21B 33/126; E21B 21/10; E21B 34/14; E21B 34/12

See application file for complete search history.

(56) References Cited

U.S. PATENT DOCUMENTS

| | | | | |
|---|---|---|---|---|
| 4,066,125 | A | 1/1978 | Bassani | |
| 4,378,838 | A | 4/1983 | Ogden et al. | |
| 4,576,042 | A * | 3/1986 | Johnson | E21B 47/10 73/152.36 |
| 4,596,395 | A * | 6/1986 | Miser | F16J 15/24 277/562 |
| 5,465,791 | A * | 11/1995 | Loitherstein | E21B 43/04 166/202 |

FOREIGN PATENT DOCUMENTS

| | | |
|---|---|---|
| CA | 1222447 A1 | 9/1985 |
| EP | 0259170 A2 | 3/1988 |
| GB | 2380748 A | 4/2003 |
| GB | 2465564 A | 5/2010 |

OTHER PUBLICATIONS

Search Report received in Great Britain application No. GB13301925.2, dated May 22, 2013.

* cited by examiner

*Primary Examiner* — Catherine Loikith
(74) *Attorney, Agent, or Firm* — Blank Rome LLP

(57) ABSTRACT

A downhole seal element (10) comprises a cup portion (11) formed of or including a resiliently deformable material. The cup portion (11) extends between on the one hand a nose part (12) comprising an annulus intended for sealingly mounting the seal element on a mandrel (22) and on the other hand a skirt (13), the seal element flaring in shape between the nose part (12) and the skirt (13). The skirt includes extending therefrom away from the nose part (12) a plurality of elongate, flexible limbs (18) that are spaced at intervals about the skirt (13).

22 Claims, 3 Drawing Sheets

DOWNHOLE SEAL ELEMENT AND RELATED APPARATUSES

BACKGROUND

Disclosed herein is a downhole seal element, and related apparatuses.

In the art of downhole tools, i.e. devices intended to be conveyed into water, oil and gas wells and similar elongate boreholes extending into subterranean formations, various types of seal element are known. They are of particular utility when used to convey tools into wells that are normally filled with a pumped, circulating fluid the chemical composition of which will vary from one well to the next.

Such a seal element typically is made from a flexible, and commonly resiliently deformable, material and includes a collar that normally lies at an in-use downhole (leading) end of the seal. The collar is sealingly secured on the exterior of some part of a downhole toolstring, typically a mandrel, that almost invariably is circular. The seal element includes a skirt that extends in use uphole (rearwardly) from the collar. By reason of the flexible nature of the material of the element the skirt is capable of moving from a collapsed position lying close to the mandrel to an expanded position flared outwardly therefrom.

The mandrel is of a smaller diameter than e.g. drillpipe temporarily defining the inner wall of the well in which it is to be conveyed. The skirt when collapsed while being of greater diameter than the mandrel nonetheless also is of a lesser diameter than the inner wall defined by the drillpipe.

The skirt may be caused to move from its collapsed to its extended position by the application of fluid pressure inside the drillpipe, with the pressure gradient acting in the downhole direction. As a result it is possible to employ one or more seals to cause movement of a downhole tool along a length of drillpipe in a fluid-filled well, as long as (a) the seal element is mounted the correct way round on the tool and (b) the circulation of fluid is such as to apply fluid pressure to the skirt in a desired direction causing the skirt to expand so that its outer periphery seals against the drillpipe. Since at this time both the innermost part of the seal element represented by the collar and the outer periphery of the skirt define seals the pumping of fluid in the well causes the tool supporting the seal element to be conveyed in a desired (normally downhole) direction.

In some cases such conveying of a tool is adequate for the purpose of deploying it from a surface location to a subterranean location. Following the completion of the intended action of the tool it may be recovered to the surface location for example by paying out a cable that may attach to the uphole end of the deployed tool using a per se known fishing neck arrangement. The cable may then be wound in to the surface location in order to recover the tool.

Such an approach is often acceptable when the tool in use is essentially autonomous. In many situations however the use of an autonomous tool is not possible.

One example of a non-autonomous tool is a wireline logging tool.

A logging tool is an elongate, cylindrical device that is conveyed to a downhole (operational) location for the purpose of logging (i.e. recording, processing and/or analyzing) data about the subterranean formation.

Wireline is a form of armored cable that is capable of transmitting electrical and electronic signals from the logging tool to a surface location. Many designs of logging tool are conveyed to their downhole locations trailing a length of wireline behind them so that log data may be telemetered immediately to an uphole location and analyzed.

Wireline offers numerous advantages in many logging situations but it is characterized by having a comparatively high mass per unit length. In some situations wireline must be paid out over a length of several thousand or even tens of thousands of feet in order to let a tool reach the total depth of a well. This means that many hundreds of kilograms of wireline may lie in the well while logging takes place.

If the well extends vertically or steeply downwardly the mass of the wireline is not seen as a particular disadvantage because gravity tends to avoid the need to apply additional energy in order to deploy it. In other words in such wells the mass of the wireline tends to be no hindrance to tool deployment.

Many wells however are not of this character, and extend horizontally (for example sideways into a hillside) or at least include sections that are not vertical or steeply descending. In such situations a need arises to pump the logging tool along the well in the manner outlined above using seals as aforesaid. When pumping under these circumstances is required the mass of the wireline becomes a significant problem because much energy is then needed to move the logging tool (which itself may weigh more than a hundred kilograms) and the wireline. This additional energy normally takes the form of an increase in the pumping pressure of the fluid circulating in the well. The pumping pressure is controlled by a logging engineer stationed at the surface location.

Furthermore the wireline and/or the tool may become snagged or impeded in some way, and at such times high pumping pressures again are employed in order to try and move the logging tool.

These factors create limits to the extent to which wireline logging tools can be pumped in wells. The limits arise either because the pumps used to circulate fluid in the wells are not capable of creating sufficiently high pressures or (more commonly) because existing seal elements when subjected to high pressures tend to fail by turning "inside out" with the result that their skirts cease to seal against the inner wall of drillpipe or casing in the well. When this happens the seal becomes useless for its intended purpose of pumping the tool; and indeed the seal may become torn or broken up such that it merely is debris inside the drillpipe.

In view of the foregoing there is a need for an improved design of seal arrangement that in particular is suitable for use when a heavy mass of wireline must be pumped along a well together with the logging tool.

SUMMARY

According to the invention in a first aspect there is provided a downhole seal element comprising a cup portion formed of or including a resiliently deformable material, the cup portion extending between on the one hand a nose part comprising an annulus intended for sealingly mounting the seal element on a mandrel and on the other hand a skirt, the seal element flaring in shape between the nose part and the skirt and the skirt including extending therefrom away from the nose part a plurality of elongate, flexible limbs that are spaced at intervals about the skirt.

Such an arrangement is as described below of particular advantage when it is required to seal a tool (or a mandrel attached to a tool) as aforesaid for pumping purposes when the tool or mandrel includes a so-called centralizer.

Preferably the cup portion in the vicinity of the nose part is of circular cross section. This suits the nose part for sealing attachment to a mandrel or similar structure forming part of a toolstring.

Also preferably the annulus includes one or more annular and/or radially extending reinforcements. These are advantageous because the material of the seal may become strained in the vicinity of the nose part, where the seal attaches to the mandrel.

Conveniently the cup portion in the vicinity of the skirt is of circular cross-section; and further conveniently the cup portion is of circular cross-section between the nose part and the skirt.

These features suit the seal for sealing inside drillpipe.

The principles of the seal of the invention as defined herein however are also suitable for sealing in a bore lined with a component other than drillpipe. Thus the seal in a modified form may be used for sealing against well casing.

Preferably the elongate, flexible limbs are spaced at equal intervals about the skirt. This aspect of the seal of the invention is particularly suitable when the mandrel is part of a centralizer having a plurality of evenly spaced bowsprings or similar centralizer features such as spring-loaded arms, as described in more detail below.

In a particularly preferred embodiment of the invention each elongate, flexible limb includes a flexible core of or including Aramid fibers. This feature confers great strength and toughness on the limbs, such that they are likely to survive incidents in which they become snagged or turned inside out in a downhole situation.

A preferred form of Aramid fiber is Kevlar®, although other fibers may be employed in the flexible cores of the limbs.

Constructionally advantageous features of the seal of the invention include that each elongate, flexible limb is joined to the skirt by way of a portion of increased width; and that each elongate flexible limb terminates in a free end that is squared off. These features have been found to confer good service life on the seal.

According to a second aspect of the invention there is provided an elongate downhole tool comprising a mandrel having sealingly secured about an outer periphery the annulus of a seal according to the invention as defined herein.

In one form of downhole tool according to the invention the seal is oriented to promote pumping of the downhole tool in a downhole direction.

This is the version of the invention expected to be most commonly embodied but it is equally possible within the scope of the invention to mount the seal on the outer periphery of the mandrel in an inverted orientation. This then would permit the seal to be used for pumping the tool in an uphole direction.

Preferably the mandrel terminates at one end in a plug that is secured inside the hollow interior so as to prevent fluid flow along the interior via the said end. The plug preferably is secured by one or more frangible retention members that fracture on fluid pressure acting on the seal reaching or exceeding a threshold value.

In such an embodiment fracturing of the one or more frangible retention members creates a fluid communication path across the seal.

Preferably the fluid communication path results from removal (typically in a downhole direction) of the plug from the downhole tool on fracturing of the one or more frangible retention members, thereby opening an otherwise closed end of the mandrel to the exterior of the downhole tool.

However in other embodiments of the invention rupturing of the one or more frangible retention members might result in opening of a fluid flow path e.g. through activation of a valve.

As a consequence the tool is pumpable, through the action of the attached seal, while the pressure of pumping fluid remains below a value corresponding to the threshold; and in the event of the pressure exceeding the threshold the plug becomes removed (or the fluid communication path becomes opened in some other way, as outlined) such that the well may be circulated by way of fluid passing along the mandrel and exiting via a downhole aperture in the tool. Logging and drilling engineers will appreciate the benefit of being able to circulate the well in this fashion, either as an emergency measure in the event of the fluid pressure exceeding the threshold value unexpectedly; or because the logging engineer intends that circulation should commence following deployment of the tool to a chosen location.

Especially when it is required to convey e.g. a logging tool along a length of horizontally extending well it is strongly desirable to centralize the tool in the well since otherwise the tool may not accurately record log data.

Various forms of centralizer are known. The majority include an annular array of spring-loaded centralizer arms that extend from a mandrel in a circular array so as to support the tool on all sides relative to the drillpipe or other medium lining the well.

The seal of the invention is as mentioned highly suitable for use in conjunction with a centralizer of the general kind described. To this end the tool preferably includes one or more resiliently biased, protruding arms, especially one or more bowspring members interconnecting two parts of the tool that are spaced from one another along its length.

Further preferably the downhole seal element is located on the mandrel such that at least a pair of the elongate, flexible limbs is extensible to either side of a said resiliently biased arms.

The arrangement of the seal element advantageously permits sealing of the seal to drillpipe or another well lining medium notwithstanding that the arms of the centralizer in the case of other seal designs would prevent the cup portion of the seal from engaging the well wall all the way around its inner periphery. In other words the flexible arms of the seal element of the invention provide for interruptions in the cup portion that accommodate centralizer arms in a way that permits maintaining of a seal.

As referred to herein the sense of the resilient biasing of the arms or other centralizer features is to bias them to protrude from the mandrel to which they are secured. Such an arrangement is known in the design of centralizers. Usually the biasing of each arm, etc., is the same; but in some designs of centralizer this is not the case. All such centralizer designs are viable in the downhole tool of the invention.

It is advantageous for the downhole tool to comprise at least one mechanism having a reversible energy store and a valve controlled by one or more moveable actuation members, wherein (a) kinetic energy of the actuation member(s) is convertible to potential energy of the reversible energy store; (b) a first movement of at least one said actuation member results in opening of the valve; (c) potential energy in the reversible energy store is convertible to kinetic energy of the actuation member(s); (d) a second movement of at least one said actuation member results in closing of the valve; and (e) opening and closing of the valve causes a change in a pressure difference across the seal element.

When the downhole tool as defined above travels in a fluid-filled bore it may enter a reduced space such as an upset or landing ring, that gives rise to variations in the diameter of the inner wall of the drillpipe. This leads to a temporary increase in the fluid pressure acting across the seal element. This can result in bursting of the seal. The foregoing aspect of the invention may be arranged to travel ahead of the seal, creating a pressure relief path on opening of the valve and hence preventing bursting of the seal at the nose part.

To this end the or each actuation member is preferably engageable with an inner wall of a fluid-filled bore such that variations in the cross-section of the bore cause movement of the actuation member(s).

In one embodiment of the mechanism, the reversible energy store is a spring that can be adjusted for preload. Preferably, the spring acts between a collar that is secured on the mandrel and a moveable sleeve movement of which results in opening and closing of the valve.

According to another aspect of the invention there is provided a downhole tool assembly comprising two or more downhole tools each according to the invention as defined herein secured together so that the hollow interiors of the respective tools are capable of communicating with one another when e.g. the plug of one of them is removed as described above. This arrangement beneficially means that two of the seal elements may be provided at spaced intervals along a toolstring, thereby minimizing the risk that during pumping the toolstring may become skewed relative to the drillpipe.

BRIEF DESCRIPTION OF THE DRAWINGS

There now follows a description of preferred embodiments of the invention, by way of non-limiting example, with reference being made to the accompanying drawings in which.

DETAILED DESCRIPTION

Figure 1:
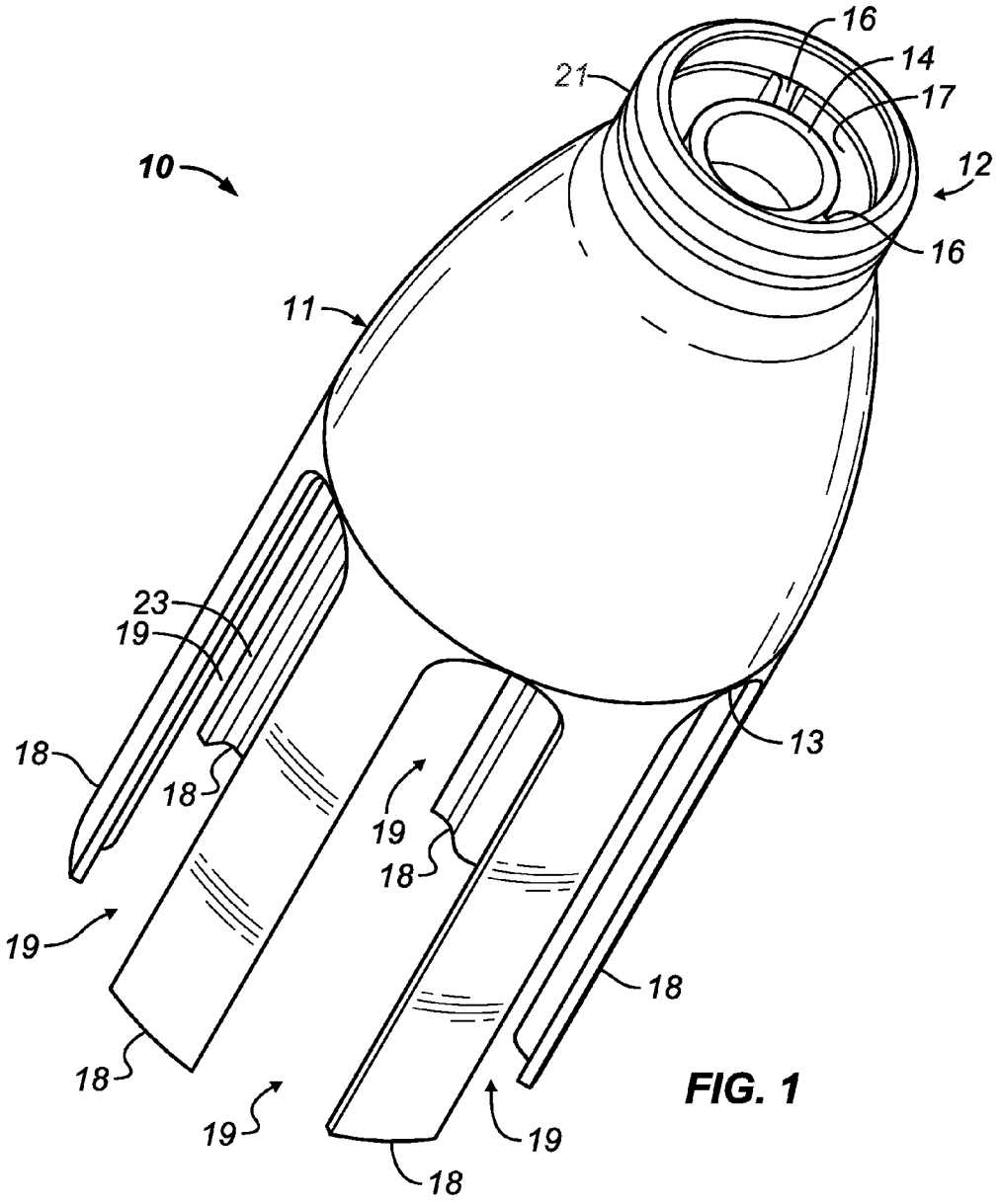
FIG. 1 is a perspective view of a seal element according to the invention, in an unstressed (non-use) condition.

Referring to the drawings a seal element 10 made predominantly from a resiliently deformable, or at least flexible, material such as a synthetic or natural rubber compound comprises a cup portion 11.

Cup portion 11 in the embodiment shown adopts essentially the form of a circular cross-section dome as illustrated and extends between a nose part 12 at one end of the seal element 10 and a hollow skirt 13 at the other end opposite the nose part end.

The nose part 12 includes a central annulus 14 defining a circular cross-section passage extending between the hollow interior of the skirt 13 and the exterior of the seal element 10 in the vicinity of the nose part 12.

The annulus 14 is of smaller internal and external diameter than the exterior of the nose part 12, and is retained and supported relative thereto by a number of reinforcements 16 described in more detail below.

By reason of its circular section dome shape the seal element 10 as illustrated flares in shape between the nose part 12 and the skirt 13.

The skirt 13 as shown is circular and includes extending in a direction away from the nose part a series of (in the embodiment described) six elongate, flexible limbs 18.

The limbs 18 are spaced at equal intervals about the periphery of the skirt 13, for a purpose described in further detail below. In consequence a series of equally-sized, elongate gaps 19 exists between the adjacent pairs of limbs 18.

Although six equally spaced limbs 18 are shown in the preferred embodiment illustrated, a different number of limbs 18 may be provided in other arrangements falling within the scope of the invention. Furthermore the spaces defining the gaps 19 between adjacent limbs 18 need not be as shown; and indeed need not necessarily be spaced equally in respect of all the limbs of the series extending from the skirt 13.

As illustrated the reinforcements 16 located in the nose part of the seal element are formed integrally with the other parts of the element 10 as a series of three (in the embodiment shown, although other numbers are possible) ribs extending radially between the annulus 14 and an outer collar 21.

The radially extending ribs defining the reinforcements 16 are shown in an equally spaced arrangement in FIG. 1 but in other embodiments within the scope of the invention other numbers and patterns of the reinforcements are possible. Reinforcement furthermore may be included in other parts of the seal, as desired.

Collar 21 defines a recess 17 in a direction receding away from the nose part 12 such that the in-use downhole facing end of the seal element 10 may be sealingly attached to a further component secured on or formed integrally with a mandrel 22 described in more detail below.

Although not visible in FIG. 1 each of the limbs 18 includes inside it one or more elongate Aramid fibers (especially Kevlar® fibers) extending from one end to the other of the limb, or at least over a sufficient length as to have a strengthening effect.

Such fibers are herein stated to define in each limb at least one core, but this does not necessarily mean that the fiber(s) necessarily must extend centrally inside each limb. Indeed off-center fiber locations are possible within the scope of the invention, as are arrangements in which the positioning of the fibers relative to the limb cross section varies (e.g. sinusoidally) along the length of the limb 18; and indeed the cross section of each limb 18 may not lend itself to centralized location of the aramid fibers.

As shown the limbs 18 furthermore include strengthening ribs 23 extending along their lengths, but these in some embodiments of the invention may be dispensed with or may adopt a variety of different lengths, shapes and cross-sections.

The effect of the foregoing features is to strengthen the limbs 18 and prevent them from being misplaced, damaged or torn off in use of the seal element 10.

Such strengthening features do not need to extend all the way along each limb 18. They may for example be interrupted at intervals or they may extend continuously over only e.g. a first part of the limb 18 measured from the skirt 13. Furthermore it is not necessary that each limb 18 is of the same design as the next adjacent limb, although in the preferred embodiment shown this is desirable in order to accommodate a series of identical bowspring arms as described below.

As shown at its point of attachment to the skirt 13 each limb 18 extends laterally in a radiused shape in order to provide a smooth joint transition and in order to maximize the amount of material of the seal element in the attachment locations. This feature assists in preventing tearing off of the limbs 18.

At the opposite, free end each limb 18 is squared off as shown, but in some other arrangements other limb end shapes (especially those that induce particular fluid flow characteristics) may be employed.

Figure 2:
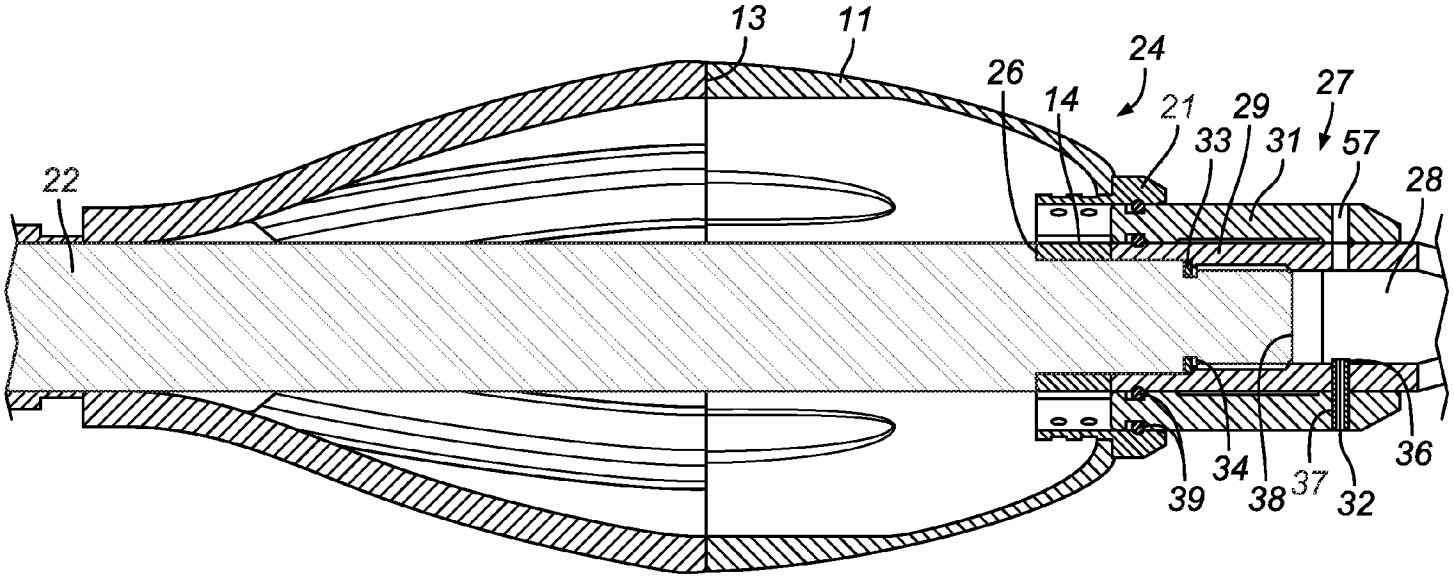
FIG. 2 is a cross-section view of part of a downhole tool mandrel having mounted thereon a seal element according to the invention.

As mentioned the seal element 10 may be secured onto the exterior of a hollow metal (e.g. steel) mandrel 22 as best illustrated in FIG. 2.

This is a cross-sectional view of part of a downhole tool 24 according to the invention.

In FIG. 2 the seal element is shown in a shape it adopts when there is no appreciable fluid pressure acting in a downhole direction.

As indicated the inner diameter of the annulus 14 is such that the annulus 14 is a sealing fit on the exterior of the mandrel 22. In practice in assembly of the downhole tool 24 annulus 14 is slid on to an in-use downhole end of the mandrel 22 until it encounters a shoulder 26 that prevents further movement in the in-use uphole direction. A sealing collar assembly 27 is then slid along the mandrel 22 also in an uphole direction so that it becomes inserted into the recess 17.

In the as-assembled condition the collar assembly 27 is impervious to fluid flow, and as illustrated includes a plug member 28.

Sealing collar assembly 27 includes inner and outer rigid (e.g. metal) collar sleeves 29, 31 that are secured one to the other by at least one shear pin 32. Shear pin 32 prevents relative axial movement between the inner and outer sleeves 29, 31.

Inner sleeve 29 includes protruding radially inwardly therefrom a tang 33 that is received in an annular groove 34 extending around the outer periphery of the mandrel 22. The tang 33 prevents axial movement of the inner collar sleeve 29 once it has been installed on the free end of the mandrel 22 from an in-use relatively downhole location.

Shear pin 32 is received in a radial bore 37 extending through the inner and outer collar sleeves 29 and 31 and extends radially inwardly beyond the inner surface of inner sleeve 29. As a result it defines a free end that is received in a recess 36 formed in the outer surface of plug 28 that in turn is a sealing fit inside the inner collar sleeve 29.

The sealing collar assembly 27 may be assembled by firstly sliding or pressing the inner sleeve 29 onto the free end of the mandrel 22. Thereafter the tang 33 may be deformed so as to enter into groove 34. This locks the inner collar sleeve onto the mandrel end.

The plug 28 is then slid or pressed inside the inner sleeve 29 and the outer sleeve 31 slid or pressed onto its exterior. As long as the bore 37 is in line along its length the shear pin 32 may be pressed or hammered into place linking the inner and outer sleeves 29, 31 and the plug 28 so as to prevent axial movement of these parts relative to one another or relative to the mandrel 22.

One or more annular ring seals 39 of an elastomeric material may be received in grooves in the outer sleeve 31 as shown in order to provide fluid-tight seals between on the one hand the inner and outer sleeves 29, 31; and on the other hand the exterior of the outer sleeve 31 and the recess 17 of the seal element.

The plug 28 closes off the otherwise open end 38 of the mandrel 22 such that under normal circumstances when the mandrel is inserted into a fluid-filled well no fluid flow via the interior of the mandrel in a downhole direction is possible.

In consequence with the seal element 10 attached as described to mandrel 22 that is inserted inside drillpipe any fluid pressure acting on the in-use uphole end of the seal element reacts against the material of the skirt 13 and the collar assembly 28 thereby tending to drive the seal element, and any component to which it is attached, in a downhole direction.

Such pressure causes the skirt 13 to flare outwardly and in the absence of other impediments seal about its annular periphery against the wall of the drillpipe, thereby giving rise to an effective seal arrangement.

In the event of fluid pressure inside the seal exceeding a threshold value for one of the reasons summarized above the shear pin 32 shears with the result that the plug 28 becomes free and is expelled from the downhole end of the tool. This opens the end 38 of the mandrel formerly closed by the plug 28, with the result that circulation of the well via the drillpipe becomes possible.

The inner and outer sleeves 29, 31 at this time are retained captive on the mandrel 22 by reason of the remnant of the shear pin 32, and the tang 33, holding them against axial movement off the end of the mandrel.

The seal element of the invention includes further features, and in particular the limbs 18, intended to enhance its use in conjunction with one or more centralizers. Use of the seal element in this way is shown in FIG. 3.

Figure 3:
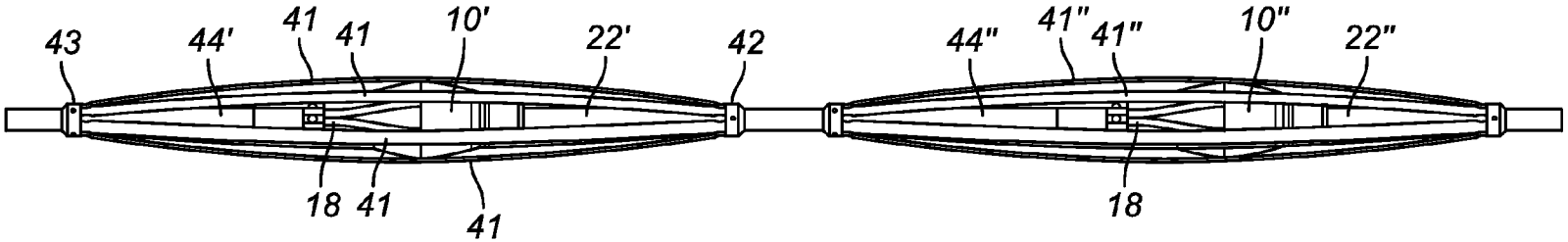
FIG. 3 is an elevational view of a downhole toolstring according to the invention.

In FIG. 3 a seal element 10' is secured on a mandrel 22' in the manner described above to define a downhole tool 44'.

In the arrangement illustrated the mandrel 22' is the core member of a centralizer having secured on its outer periphery an annular series of resiliently deformable bowsprings 41.

In the arrangement shown there are six bowsprings spaced at equal intervals on the exterior of the mandrel 22', but only four of the bowsprings are visible in the view presented.

As is well known in centralizer design, the bowsprings 41 each are fixed to the mandrel 22' at one end by way of a fixed, common collar 42 and are slideably secured at the other. The material of each bowspring 41 is resiliently deformable and may be for example a high Young's modulus steel. The result is an arrangement in which a series of leaf springs is presented on the exterior of the mandrel 22'.

The slideable connection of the bowsprings 41 is achieved by way of a common, slideable collar 43. The arrangement overall is such that pressure on one of the bowpsrings caused e.g. by the mass of the toolstring pressing downwardly on the interior of horizontally extending drillpipe causes inward deformation of the bowspring in question. Since at the slideable and non-slideable collars 43 and 42 the bowsprings are joined together about the periphery of the mandrel 22' the overall effect is to prevent the depressed bowspring from collapsing entirely, with the result that the tendency of the toolstring to lie on the lowermost part of the inside of the drillpipe is resisted.

In practice all the bowsprings are in contact with the drillpipe wall simultaneously such that the tool is maintained at a central position inside it. This is the preferred position of the tool while it is being pumped inside the drillpipe.

The bowsprings 41 however interrupt the available drillpipe wall for sealing by the skirt 13.

In view of this the limbs 18 are provided in order to present sections of the seal element 10' that lie interposed between the drillpipe wall regions obliterated by the bowsprings 41.

The shapes and dimensions of the limbs 18 are such that in conjunction with the bowsprings 41, the remainder of the seal element 10' and the sealing collar assembly 27 an adequate seal is maintained to cause movement of the tool when a downhole pressure gradient is applied. During such a time the limbs 18 are protected against damage by the various strengthening features, such as the Aramid fiber cores and the ribs 23, described herein.

One significant advantage of being able to locate the seal element 10' inside the envelope defined by the bowsprings 41 is that the overall length of the tool does not have to be increased in order to accommodate the seal element 10'.

In practice as shown in FIG. 3 the tool 44' may be assembled into a toolstring with another, similar tool 44" in which the bowsprings 41" of a further centralizer encircle a second seal 10" mounted on a second mandrel 22". The respective mandrels 22', 22" are secured end-on to one another in a per se known way such that their hollow interiors are capable of communicating with one another in the absence of the plug of at least one of the sealing collar assemblies.

Such an arrangement provides for centralizing of the toolstring at two axially spaced positions while also providing for pumped driving of the toolstring at two such locations as well. This arrangement ensures that the toolstring is conveyed without tilting relative to the drillpipe wall.

Although the centralizer shown has resiliently deformable bowsprings, another design of centralizer includes resiliently spring-loaded, outwardly protruding arms.

Such a centralizer presents a similar sealing problem as the bowspring centralizer described above. The seal element of the invention is suitable for providing a seal in the vicinity of such an arm-type centralizer, with the limbs 18 interposed between the arms in a similar manner to that in which they lie between the bowsprings 41 in order to seal against the drillpipe wall.

In addition to the arrangements described above it is possible within the scope of the invention to secure the seal element 10 on the mandrel 22 or a similar article in an orientation that is inverted compared to that shown in FIGS. 2 and 3.

When so configured the seal element 10 may be employed to permit pumping of the tool 24 in an uphole direction instead of the downhole pumping made possible by the FIGS. 2 and 3 combination.

When the seal element is applied in this uphole pumping orientation it may be necessary to modify the downhole tool or other equipment associated with it. Such modification may be needed for example to ensure correct fluid flows and/or to ensure that the seal element 10 becomes free to be inflated by downhole fluid only when uphole tool pumping is required.

A further problem that may arise during use of a logging tool as described above, when passing through a restriction in drillpipe such as a landing ring or internal upset, is a short-lived increase in fluid pressure inside the seal element 10. This is caused by squeezing of the fluid-filled skirt 13 as it passes through the restriction, and may lead to tearing or bursting of the seal element 10 such that it ceases to be functional.

In order to avoid this problem it is desirable to provide a means of temporary pressure relief or equalization that may accommodate sudden pressure increases as described. Such an arrangement is described with reference to FIGS. 4 and 5, which show a pressure relief mechanism 51 that operates to control pressure levels across the seal element 10.

The pressure relief mechanism 51 consists of a reversible energy store (which is preferably a spring 49 although other energy store types, as would occur to the skilled worker, also are possible), actuation member(s) **46*a* and 46*b*, on outer sleeve 47, and a moveable, inner sleeve 48. The pressure relief mechanism 51 is secured on the mandrel 22 at the nose part 12 of the seal element 10**.

In particular the circular outer sleeve 47 is sealingly received within the annulus 14 of the seal element 10. Moveable inner sleeve 48 is slidingly mounted on the exterior of the mandrel 22 and is moveable longitudinally relative to both the mandrel 22 and the outer sleeve 47. The inner and outer surfaces of the inner sleeve 48, and/or the inner surface of outer sleeve 47 and the outer surface of mandrel 22, may include sealing arrangements such as the per se known O-ring and groove combinations 53 visible in FIGS. 4 and 5.

The inner sleeve 48 is partially received within the hollow interior of the outer sleeve 47 such that the two sleeves overlap over parts of their respective lengths, with part of the inner sleeve 48 protruding on the mandrel 22 in a downhole direction externally of the outer sleeve 47.

Figure 4:
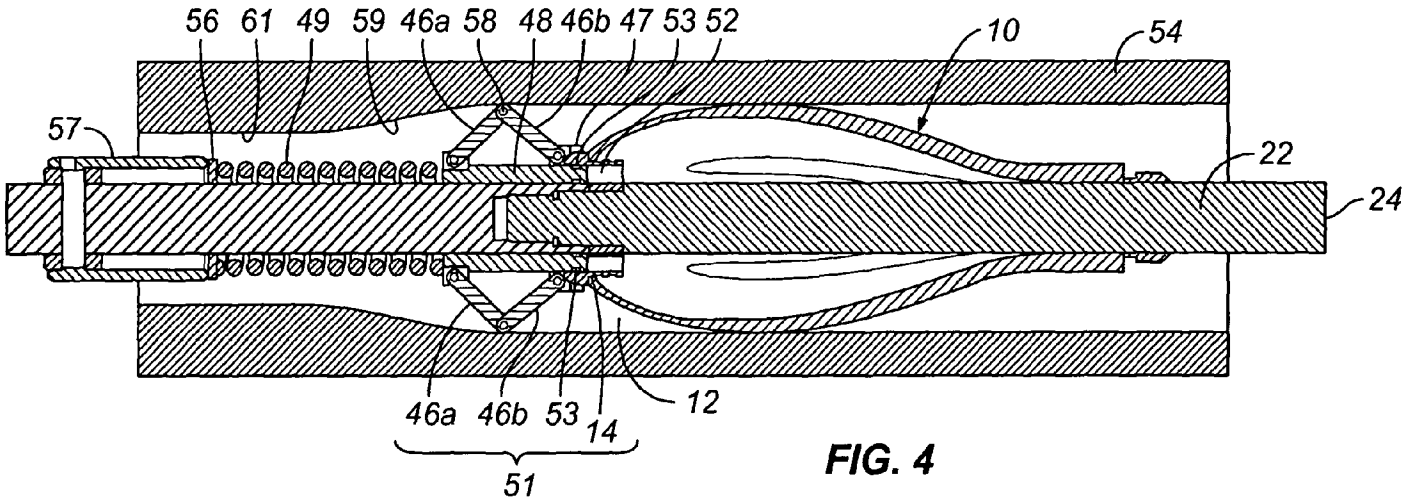
FIGS. 4 and 5 are cross-sectional views of a variant of the downhole tool mandrel of FIG. 2 showing the construction and operation of a pressure relief mechanism.

When as shown in FIG. 4 the logging tool 24 is running in a length of drillpipe 54 of relatively large internal diameter the degree of overlap between the outer 47 and inner 48 sleeves is such as to close off one or more fluid flow passages 52 defined by apertures in outer sleeve 47 that at such a time are covered by the inner sleeve 48 such that the full pump pressure difference acts across the seal element 10 in order to drive the tool 24 in a downhole direction.

The actuation member has two rigid arms **46*a* and 46*b* forming a pantograph-like arrangement, wherein one arm 46*a* of the pantograph is pivotably secured one end to the end of a moveable inner sleeve 48 that protrudes beyond outer sleeve 47. The opposite end of arm 46*a* is pivotably secured to an end of arm 46*b*. The other end of arm 46*b* is pivotably secured to the exterior of outer sleeve 47 with the result that the joint between the arms 46*a* and 46*b* defines an elbow 58 that may be caused to engage the inner wall of the drillpipe 54**.

The spring 49 encircles the mandrel 24 and acts between the downhole end of inner sleeve 48 and an anchor plate 56 that is rigidly secured to the mandrel 24 downhole of the sleeve 48.

Anchor plate 56 is optionally secured on a screw-mounted collar 57 the position of which relative to the seal element 10 may be adjusted in order to tune the preload of the spring 49. The force exerted by the spring 49 maintains the elbow 58 in contact with the drillpipe inner wall 59. The spring force is chosen such that the pump pressure does not under normal circumstances cause the inner sleeve 48 to move downhole relative to the outer sleeve 47.

The above arrangement of the pressure relief mechanism however causes any compressional force on the actuation member to translate as longitudinal movement of the moveable sleeve.

When the downhole tool is travelling "normally" as illustrated in FIG. 4, and has not entered a reduced diameter part of the drillpipe, as noted the spring force prevents any longitudinal movement of the moveable sleeve 48 along the mandrel 22.

Figure 5:
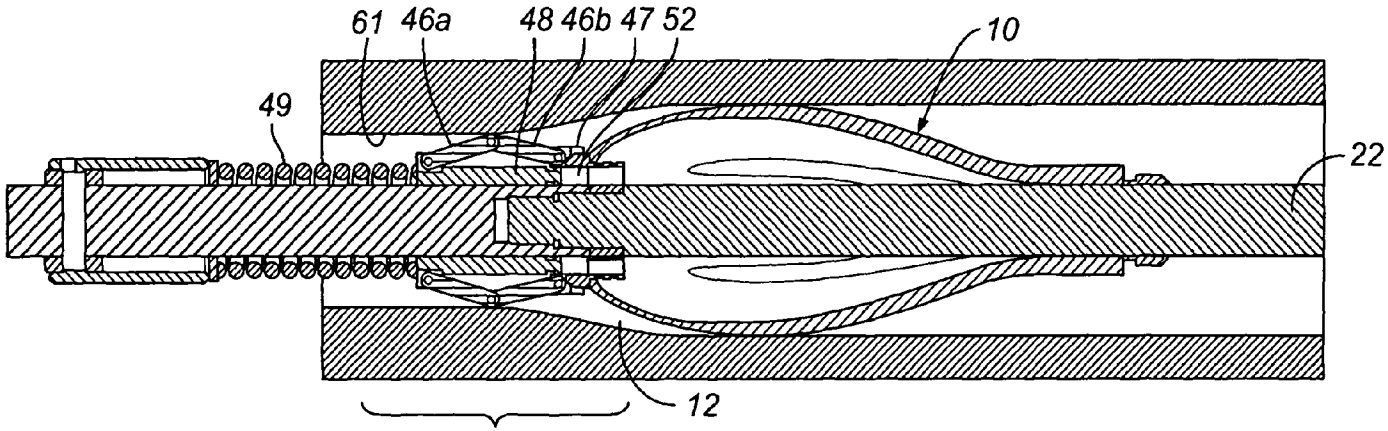

However when the downhole tool enters a reduced inner diameter section of the drillpipe, such as the internal upset 61 visible in FIGS. 4 and 5, the elbow 58 of the pantograph becomes compressed as shown in FIG. 5. The compressive force overcomes the force exerted by spring 49, with the result that actuation arm **46*a* moves in a direction away from the seal element 10 and as it does so, moveable sleeve 48 which is secured at one end to arm 46***a* also moves in the same direction. This results in opening of the fluid flow passage 52.

The temporary increase in the fluid pressure acting across the seal, due to the tool entering a reduced space, is thereby relieved when the fluid flow passage 52 opens.

The kinetic energy from the movement of arm 46*a* and moveable sleeve 48 translates into potential energy of the spring 49 as the spring compresses.

When the tool 24 leaves the reduced-diameter section of the drillpipe, the restoring potential energy in the spring 49 causes the actuation arm 46*a* and the moveable sleeve 48 to move along the mandrel 22 towards the seal element (in the direction of the restoring spring force). The conversion of potential energy in the spring to kinetic energy of the actuation member closes the fluid flow passage 52 with the result that the full pump fluid pressure difference is again able to develop across the seal element 10.

As is apparent from the foregoing and from FIGS. 4 and 5 the arrangement thereof amounts to a valve that opens temporarily, in order to prevent the seal element bursting problem described above, before subsequently closing again. In the illustrated variant of the invention therefore the plug 28 of e.g. FIG. 2 is replaced by the mechanism described.

As is also apparent from FIGS. 4 and 5 in practical versions of the variant at least two pairs of the actuation arms 46*a*, 46*b* are provided connected in a similar manner on opposite sides of the mandrel. This ensures that any compressional force transmitted to the spring is centered in at least the plane of the actuation arms 46*a*, 46*b* thereby reducing the risk of binding of the inner sleeve 48 onto the mandrel. In other embodiments of the invention it may be possible to provide e.g. three or four pairs of the actuation arms at equi-spaced intervals around the circumstance of the inner sleeve 48. Such arrangements while more complex than those illustrated nonetheless lie within the scope of the invention as claimed.

The listing or discussion of an apparently prior-published document in this specification should not necessarily be taken as an acknowledgement that the document is part of the state of the art or is common general knowledge.

The invention claimed is:

1. A downhole seal element for sealing between a mandrel and a bore in which the mandrel is moveable, the seal element comprising:

a cup portion formed of or including a resiliently deformable material, the cup portion having a first end disposed against the mandrel at a first point and connected to a second end of the seal element disposed against the mandrel at a second point, the cup portion extending between on the first end a nose part comprising an annulus intended for sealingly mounting the seal element on the mandrel and on the second end a skirt, the seal element flaring in a bowed shape between the nose part at the first end and the skirt at the second end, and the skirt including, extending therefrom away from the nose part, a plurality of elongate, flexible limbs that are spaced at intervals about the skirt.

2. The downhole seal element according to claim 1, wherein the cup portion in the vicinity of the nose part is of circular cross section.

3. The downhole seal element according to claim 1, wherein the annulus includes one or more annular and/or radially extending reinforcements.

4. The downhole seal element according to claim 1, wherein the cup portion in the vicinity of the skirt is of circular cross-section.

5. The downhole seal element according to claim 1, wherein the cup portion is of circular cross-section between the nose part and the skirt.

6. The downhole seal element according to claim 1, wherein the elongate, flexible limbs are spaced at equal intervals about the skirt.

7. The downhole seal element according to claim 1, wherein each elongate, flexible limb includes a flexible core of or including Aramid fibers.

8. The downhole seal element according to claim 1, wherein each elongate, flexible limb is joined to the skirt by way of a portion of increased width.

9. The downhole seal element according to claim 1, wherein each elongate flexible limb terminates in a free end that is squared off.

10. An elongate downhole tool for passage in a fluid-filled bore, the tool comprising:

a mandrel having an outer periphery;

a downhole seal element for sealing between the mandrel and the fluid-filled bore in which the mandrel is moveable, the seal element comprising:

a cup portion formed of or including a resiliently deformable material, the cup portion having a first end disposed against the mandrel at a first point and connected to a second end of the seal element disposed against the mandrel at a second point, the cup portion extending between on the first end a nose part comprising an annulus sealingly secured about the outer periphery of the mandrel and on the second end a skirt, the seal element flaring in a bowed shape between the nose part at the first end and the skirt at the second end, and the skirt including, extending therefrom away from the nose part, a plurality of elongate, flexible limbs that are spaced at intervals about the skirt.

11. The downhole tool according to claim 10, wherein the seal element is orientated to promote pumping of the downhole tool in a downhole direction in the fluid-filled bore.

12. The downhole tool according to claim 10, wherein the seal element is orientated to promote pumping of the downhole tool in an uphole direction in the fluid-filled bore.

13. The downhole tool according to claim 10, wherein the mandrel terminates at one end in a plug that is secured inside a hollow interior of the mandrel so as to prevent fluid flow via the end.

14. The downhole tool according to claim 10, wherein the mandrel terminates at one end in a plug that is secured inside a hollow interior of the mandrel so as to prevent fluid flow via the end; and wherein the plug is secured by one or more frangible retention members that fracture on fluid pressure acting on the plug reaching or exceeding a threshold value.

15. The downhole tool according to claim 10, wherein the mandrel terminates at one end in a plug that is secured inside a hollow interior of the mandrel so as to prevent fluid flow via the end; wherein the plug is secured by one or more frangible retention members that fracture on fluid pressure acting on the plug reaching or exceeding a threshold value; and wherein fracturing of the one or more frangible members creates a fluid communication path across the seal element.

16. The downhole tool according to claim 10, including one or more resiliently biased, protruding arms.

17. The downhole tool according to claim 10, including one or more resiliently biased, protruding arms, wherein the downhole seal element is located on the mandrel such that at least a pair of the elongate, flexible limbs is extensible to either side of said resiliently biased arm.

18. The downhole tool according to claim 10, comprising:

at least one mechanism having a reversible energy store and a valve controlled by one or more moveable actuation members, wherein:

(a) kinetic energy of the one or more actuation members is convertible to potential energy of the reversible energy store;

(b) a first movement of at least one of said one or more actuation members results in opening of the valve;

(c) potential energy in the reversible energy store is convertible to kinetic energy of the one or more actuation members;

(d) a second movement of at least one of said one or more actuation members results in closing of the valve; and (e) opening and closing of the valve causes a change in a pressure difference across the seal element.

19. The downhole tool according to claim 10, comprising:

at least one mechanism having a reversible energy store and a valve controlled by one or more moveable actuation members, wherein:

(a) kinetic energy of the one or more actuation members is convertible to potential energy of the reversible energy store;

(b) a first movement of at least one of said one or more actuation members results in opening of the valve;

(c) potential energy in the reversible energy store is convertible to kinetic energy of the one or more actuation members;

(d) a second movement of at least one of said one or more actuation members results in closing of the valve; and (e) opening and closing of the valve causes a change in a pressure difference across the seal element; and wherein each of the one or more actuation members is engageable with an inner wall of the fluid-filled bore such that variations in the cross-section of the bore cause movement of the one or more actuation members.

20. The downhole tool according to claim 10, comprising:

at least one mechanism having a reversible energy store and a valve controlled by one or more moveable actuation members, wherein:

(a) kinetic energy of the one or more actuation members is convertible to potential energy of the reversible energy store;

(b) a first movement of at least one of said one or more actuation members results in opening of the valve;

(c) potential energy in the reversible energy store is convertible to kinetic energy of the one or more actuation members;

(d) a second movement of at least one of said one or more actuation members results in closing of the valve; and (e) opening and closing of the valve causes a change in a pressure difference across the seal element; and wherein the reversible energy store is a spring that can be adjusted for preload.

21. The downhole tool according to claim 10, comprising:

at least one mechanism having a reversible energy store and a valve controlled by one or more moveable actuation members, wherein:

(a) kinetic energy of the one or more actuation members is convertible to potential energy of the reversible energy store;

(b) a first movement of at least one of said one or more actuation members results in opening of the valve;

(c) potential energy in the reversible energy store is convertible to kinetic energy of the one or more actuation members;

(d) a second movement of at least one of said one or more actuation members results in closing of the valve; and (e) opening and closing of the valve causes a change in a pressure difference across the seal element; wherein the reversible energy store is a spring that can be adjusted for preload; and wherein the spring acts between a collar that is secured on the mandrel and a moveable sleeve movement of which results in opening and closing of the valve.

22. A downhole tool assembly, comprising:

two or more downhole tools each according to claim 10, wherein the two or more downhole tools are secured together so that hollow interiors of the respective tools are capable of communicating with one another.

* * * * *